US006581521B1

(12) United States Patent
Dixon et al.

(10) Patent No.: US 6,581,521 B1
(45) Date of Patent: Jun. 24, 2003

(54) REUSABLE GAS GRENADE CANISTER

(76) Inventors: Robert G. Dixon, 5576 Golden Leaf Ave., Las Vegas, NV (US) 89122; Robert G. Dixon, Jr., 1142 Stable Glen Dr., North Las Vegas, NV (US) 89031

( * ) Notice: Subject to any disclaimer, the term of this patent is extended or adjusted under 35 U.S.C. 154(b) by 0 days.

(21) Appl. No.: 10/229,188

(22) Filed: Aug. 26, 2002

(51) Int. Cl.[7] ..... F42B 12/46

(52) U.S. Cl. ..... 102/368; 102/334; 102/367; 102/370

(58) Field of Search ..... 102/334, 335, 102/367, 368, 370, 482

(56) References Cited

U.S. PATENT DOCUMENTS

| | | | | |
|---|---|---|---|---|
| 1,281,939 A | * | 10/1918 | Gieda | 102/482 |
| 1,961,364 A | | 6/1934 | Hunter | |
| 2,079,008 A | | 5/1937 | Goss | |
| 2,094,561 A | | 9/1937 | Lowy | |
| 2,959,127 A | | 11/1960 | Weinert | |
| 3,492,945 A | * | 2/1970 | Filippi | 102/498 |
| 3,685,450 A | | 8/1972 | Walbeck et al. | |
| 3,711,115 A | * | 1/1973 | Lohr | 280/736 |
| 3,795,197 A | * | 3/1974 | Levenson | 102/368 |
| 4,186,664 A | | 2/1980 | Huber et al. | |
| 4,436,034 A | | 3/1984 | Jacobsen et al. | |
| 4,444,111 A | | 4/1984 | Luebbers | |
| 4,448,129 A | | 5/1984 | Gabriels | |
| 5,085,147 A | | 2/1992 | Gold et al. | |
| 5,619,009 A | | 4/1997 | Grouyellec | |
| 5,700,971 A | | 12/1997 | Rayer et al. | |
| 5,824,945 A | * | 10/1998 | Barlog et al. | 102/482 |
| 5,929,369 A | * | 7/1999 | Bissig et al. | 102/334 |
| 5,983,801 A | | 11/1999 | Brunn | |
| 5,996,503 A | * | 12/1999 | Woodall et al. | 102/498 |

FOREIGN PATENT DOCUMENTS

| | | | |
|---|---|---|---|
| DE | 2555323 | * | 5/1979 |
| DK | 0071293 | * | 7/1950 |

OTHER PUBLICATIONS

EPO 0274815, Jul. 1998, Davies.*

* cited by examiner

*Primary Examiner*—Michael J. Carone
*Assistant Examiner*—Troy Chambers
(74) *Attorney, Agent, or Firm*—Weide & Miller, Ltd.

(57) ABSTRACT

One embodiment of a reusable gas grenade canister includes an inner casing defining an interior space. An outer casing is spaced from the inner casing. A top plate is used to close a top end of the canister. Offset ports extend through the inner and outer casings. Fins extend outwardly from the outer casing for elevating the canister above a support surface. In use, a grenade is located and secured within the interior space. Upon ignition, material is expelled from the grenade into the interior space, then flows through the ports into the baffle space, then to a point exterior of the canister. In another embodiment, the canister comprises a body defining an interior space and includes a spike extending therefrom, the spike defining a flow path for gas to flow from the interior space to a point remote from the body.

15 Claims, 7 Drawing Sheets

REUSABLE GAS GRENADE CANISTER

FIELD OF THE INVENTION

The present invention relates to a container for a gas grenade, and more specifically to a reusable gas grenade canister for housing a gas grenade and releasing gas and other material emitted from the grenade.

BACKGROUND OF THE INVENTION

Hand grenades are a widely utilized and well known weapon that exists in many different varieties. One such type of hand grenade is known as a chemical or gas grenade. These grenades are designed to produce and release gas and/or smoke. In some variations, the grenade may be configured to release a lethal gas. Such grenades may be used in combat situations. Most commonly, the grenades are constructed to produce and release a gas and/or smoke which is an irritant, such as tear gas.

These types of gas grenades are commonly used by the military and other government agencies, such as various law enforcement agencies, as a means of defense and as a means to gain control over specific situations (i.e. riot control). For example, gas grenades are often used when large crowds become unruly as a means to disperse the crowd. In another example, a gas grenade may be thrown into a home or similar structure in an attempt to coax the one or more individuals out of the structure.

In use, the grenades are activated or ignited and then launched to the desired location, such as by throwing them. It will be appreciated that the grenades may be used in a variety of locations and may come to rest upon any of a variety of surfaces or adjacent to a variety of items. Generally, the gas grenade is configured to expel the gas and/or smoke very quickly. As such, a high rate of ignition is required, and the grenade produces intense heat and, very often, flames. Once the grenade comes to a rest, the supporting surface and surrounding items are exposed to the high heat and flame generated by the grenade. In these situations, the grenade itself poses a fire hazard and may result in substantial damage. As indicated above, tear gas and similar grenades are generally utilized as a non-lethal and non-destructive weapon. The creation of a hazardous fire is inconsistent with these goals.

Another problem is that in some situations it is difficult to throw or launch the grenade to the desired location. For example, fugitives may hole up inside a building. If the building has windows in desired locations, it may be possible to throw the grenade through the window. However, if windows or the like do not exist or are blocked, then it may not be possible to introduce the grenade into the interior space of the building.

A method of overcoming these problems while still permitting a gas grenade to be effective in use is desired.

SUMMARY OF THE INVENTION

The present invention is a reusable gas grenade canister such as for housing gas grenades, and a method of using the gas grenade canister.

In one embodiment, the gas grenade canister comprises an outer casing and an inner casing, each having a first end and an opposing second end. The inner casing defines an interior space for housing a gas grenade.

A bottom or bottom plate encloses the second end of the outer and inner casings. In one embodiment, a top plate may be used to selectively close the first end of the inner and outer casing. In one arrangement, the top plate is moveable between a first position and second position. The first position permits access to the interior space of the inner casing. The second position effectively seals the first end of the inner and outer casing, including the interior space of the inner casing.

The outer casing is spaced from the inner casing, creating a baffle space between the inner and outer casing. One or more first ports extend through the inner casing, defining one or more passages from the interior space to the baffle space. One or more second ports extend through the outer casing from the baffle space to a point external to said canister. Preferably, the one or more first ports are offset from the one or more second ports.

A plurality of spaced apart fins extend from the outer casing. The fins are configured to maintain the outer casing away from surrounding items and supporting surfaces, reducing the transfer of heat from the outer casing to those items and surfaces. In one embodiment, the fins also extend beyond the bottom end of the canister at the bottom plate.

In one embodiment, the top plate connects to a lock ring. The lock ring extends beyond the top end of the outer casing. The lock ring comprises a wall having a plurality of notches located in it. The top plate has a plurality of lugs for alignment with the notches. When aligned, the top plate may be lowered into engagement with the top ends of the outer casing and inner casing. Slots extend from each notch in the lock ring. When positioned, the lock ring may be rotated so that the lugs are positioned in the slots, preventing upward movement of the top plate from the top ends of the outer casing and inner casing. In one embodiment, a thumb screw may be used to prevent rotation of the top plate out of this secure position.

The reusable gas grenade canister is configured to house a gas grenade during use, and specifically to prevent heat transfer to surrounding items and prevent the surrounding items from being exposed to flame.

In use, in a preferred arrangement, the canister is opened to provide access to the interior space. The grenade is then located in the canister. Once the grenade is located within the interior space, the canister is secured to prevent the grenade from becoming disengaged.

The gas grenade is next ignited, causing the gas grenade to emit material (e.g. gas)into the interior portion of the canister. The material is prevented from flowing from the interior portion or space by the top and bottom plates covering the ends of the inner casing. Instead, the material must flow into the baffle space through the port(s) in the inner casing. The material is then also preventing from flowing from the baffle space by the top and bottom plates covering the ends of the outer casing. The material flows from the baffle space to a point exterior to the canister through the port(s) in the outer casing.

Because of the offset configuration of the ports and the baffling, the canister prevents flames expelled by the ignited gas grenade from reaching surrounding items and surfaces. In addition, the fins and lock ring elevate the outer casing, top plate and bottom plate, above surrounding items and surfaces. This reduces the transfer of heat from the heated outer casing, top plate and bottom plate, to those items and surfaces. At the same time, however, the gas is permitted to flow from the gas grenade through the canister for release.

The gas grenade canister is capable of being repeatedly reused. Once a gas grenade has been expended, it may be removed by removing the top plate. The gas grenade canister is then again ready for use.

In another embodiment, the canister comprises a body which defines an interior space. A plate may be removed from one of the ends of the body, providing access to the interior space for locating a grenade therein.

The canister includes a spike which extends outwardly from the body. A first end of the spike is connected to the body and a second end is located remote from the body. The spike defines at least one passage from the body to at least one port at the second end of the spike. In this embodiment of the canister, gas is released from a gas grenade into the interior space of the body. The gas is routed through the spike and released through the one or more ports.

In one embodiment, the canister includes a baffle. The baffle prevents gas and other material emitted from the grenade from flowing in a direct path to the spike, reducing the probability that flame or the like may travel through the spike and be emitted therefrom.

In one embodiment, an arm is connected to the body of the container. The arm permits the body, and thus the spike, to be swung to penetrate the spike through a member such as a wall or door.

In one embodiment, the container includes a ram plate. The ram plate extends over and is spaced from the top end of the plate opposite the spike. The ram plate defines a contact surface which may be impacted to drive the spike. In one embodiment, the plate is connected to the ram pad. The ram pad and plate may be connected to or disconnected from the body.

In use, the spike is driven through a member, such as a building wall or door. The spike may be driven by impacting the ram pad or swinging the canister with the arm.

Gas or other material emitted from a gas grenade placed in the interior space is directed through the spike and discharged through the ports. In this manner gas is routed to a point remote from the body, such as to the interior of a building.

Further objects, features, and advantages of the present invention over the prior art will become apparent from the detailed description of the drawings which follows, when considered with the attached figures.

DETAILED DESCRIPTION OF THE INVENTION

The invention is a reusable gas grenade canister and a method of using a reusable gas grenade canister. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the present invention comprises a device for housing a gas grenade during use. In one embodiment, the device is configured to provide an insulating barrier between the grenade and an ignitable surface. Generally, the device comprises a canister having a baffle construction with inner and outer casings and a hollow interior for accepting a grenade within. In another embodiment, the device is configured to route gas emitted from a gas grenade to a remote location.

The canister of the invention may be used to house a wide variety of devices. As indicated, in the preferred embodiment, the device is a gas grenade, such as a tear gas or smoke grenade.

Figure 3:
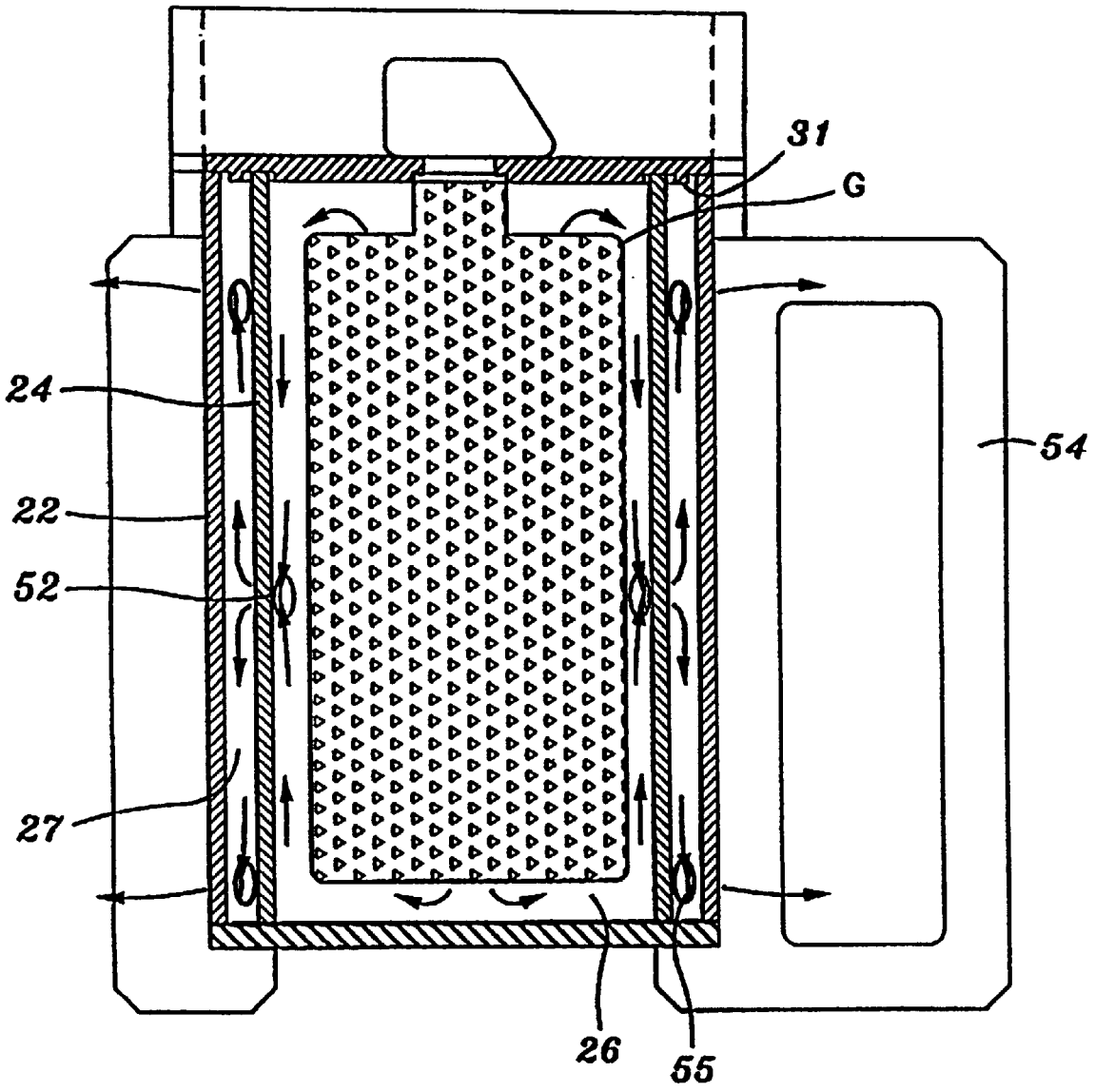
FIG. 3 is another view of the canister as illustrated in FIG. 2 including a gas grenade and illustrating flow paths of gas released from the grenade through the canister.
Figure 5:
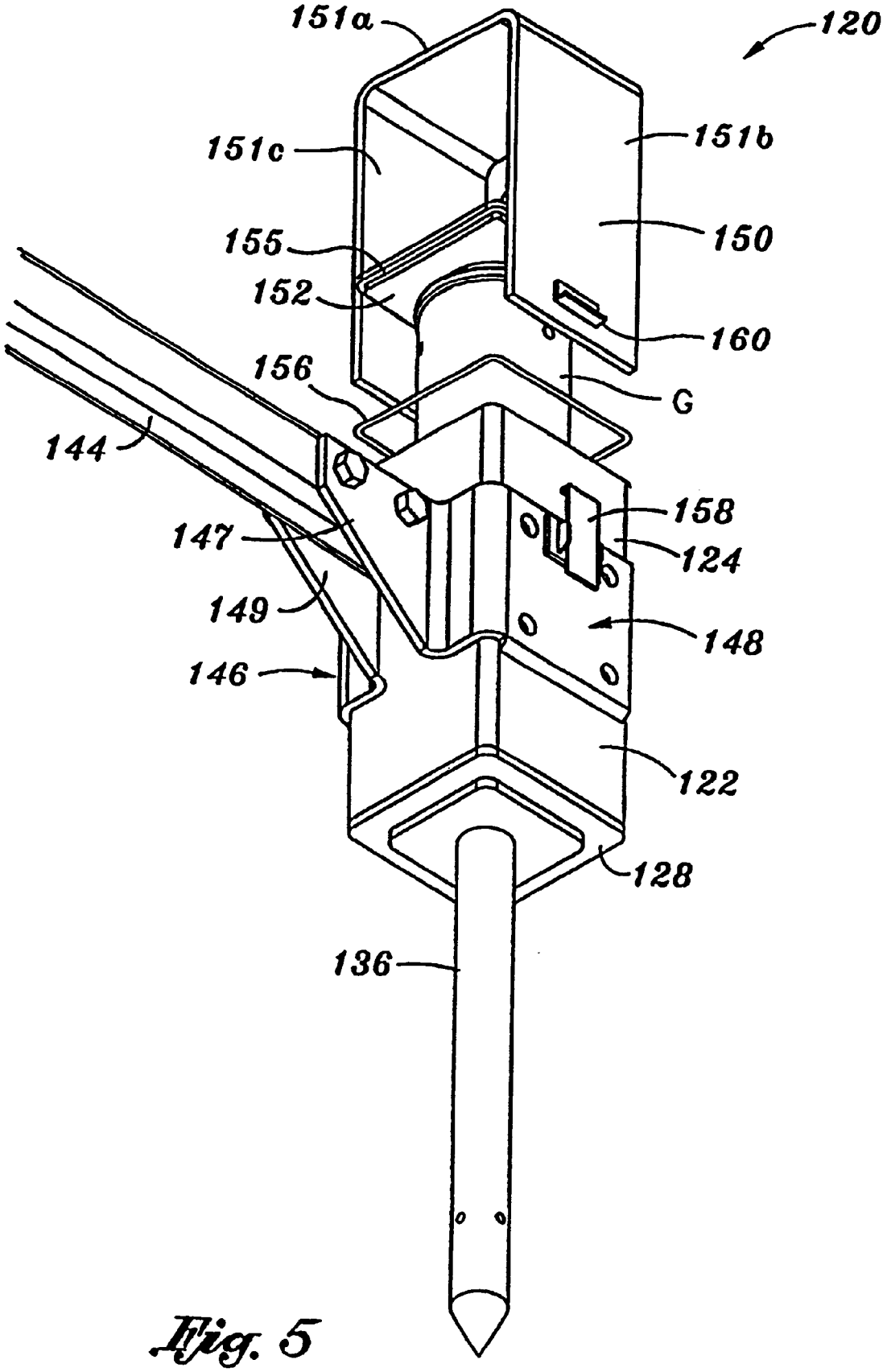
FIG. 5 is an exploded view of the canister as illustrated in FIG. 4.

Generally, as illustrated in FIGS. 3 and 5, the canister in accordance with the invention is configured to house a grenade G. The gas grenade G may have a wide variety of constructions. Generally, the grenade G has a body or housing. Filler, such as ignitable chemical and/or other material, is located in the housing. At least one threaded hole is located at the top of the housing permitting a fuse to be connected to the housing and extended into the interior thereof for igniting the chemical therein.

Though not illustrated, the grenade G generally includes a safety pin, a safety lever, a striker, a primer and an igniter/detonator. The safety pin and safety lever prevent detonation of the grenade G until such is desired by a user. Once the safety pin is pulled, the safety lever is released and the striker strikes the primer, which causes it to ignite, setting fire to the fuse. The fuse burns for a short time before reaching the detonator, causing action or ignition of the filler (i.e. dispersion of the gas).

Figure 1:
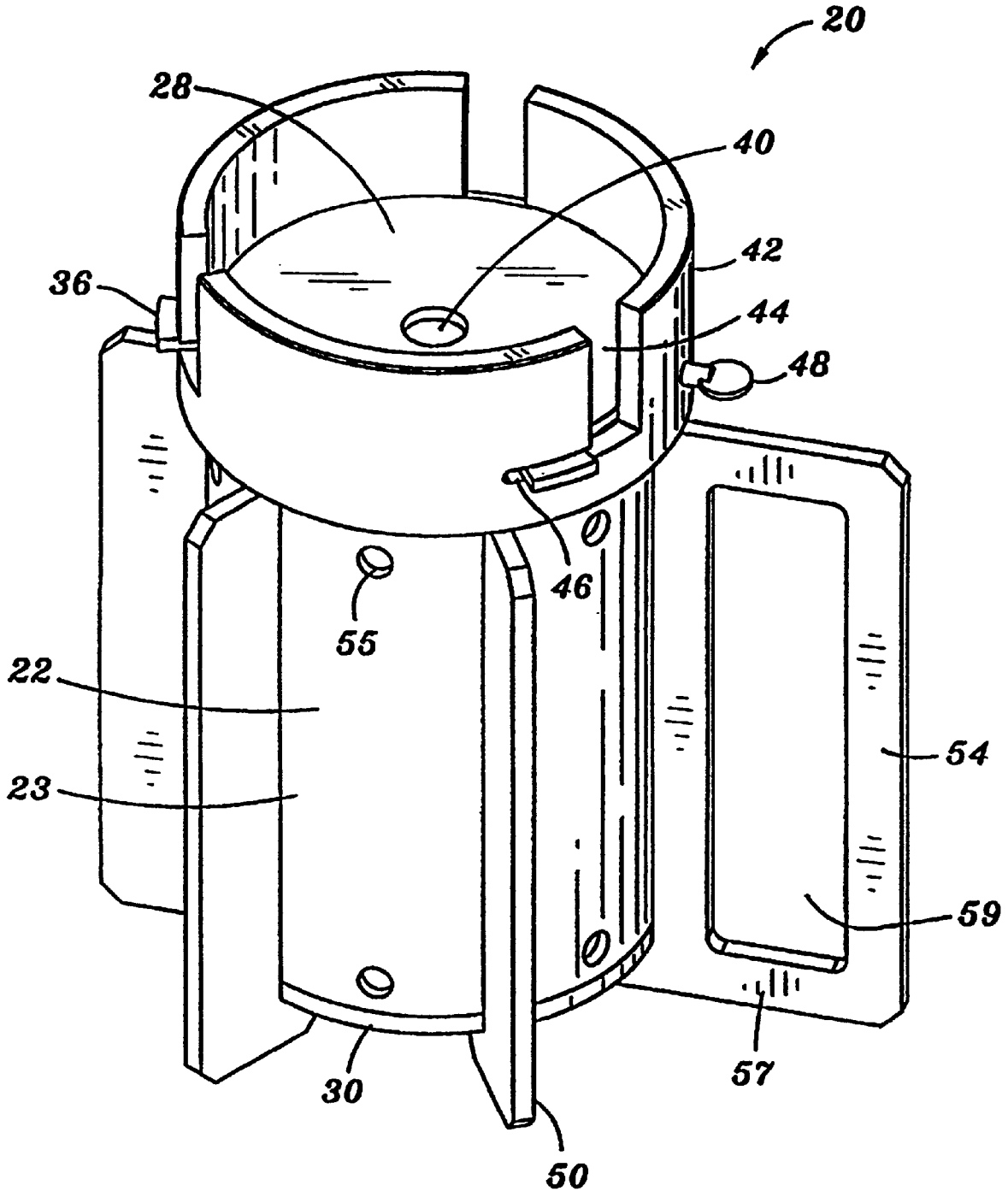
FIG. 1 is a perspective view of one embodiment of a reusable gas grenade canister of the invention.
Figure 2:
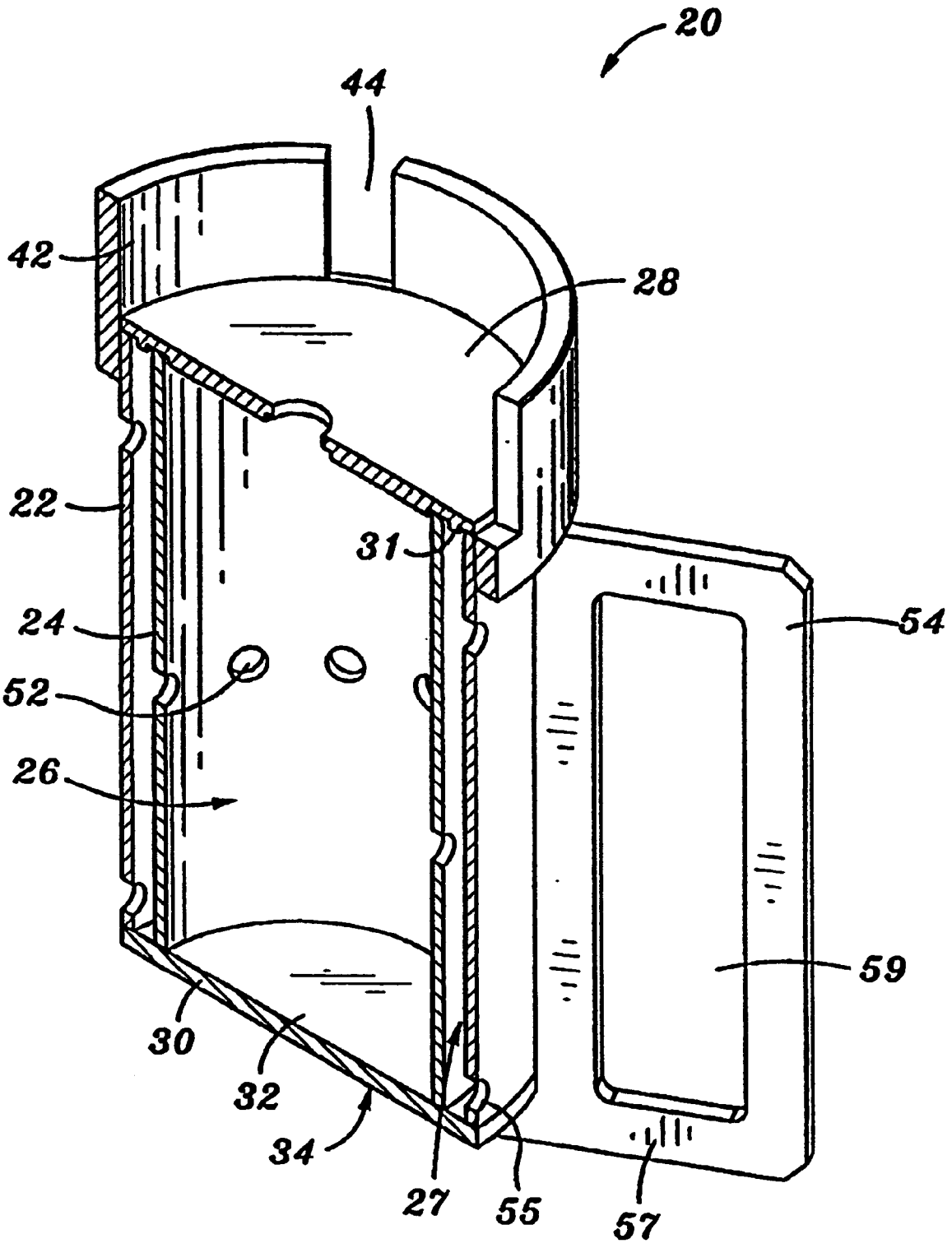
FIG. 2 is a cross-sectional view of the reusable gas grenade canister illustrated in FIG. 1 taken along line 2—2 therein.

FIG. 1 illustrates a gas grenade canister 20 in accordance with one embodiment of the present invention. The gas grenade canister 20 has a main body portion. In one embodiment, the body includes an outer casing 22 and, as best illustrated in FIG. 2, an inner casing 24. In a preferred embodiment, the inner casing 24 defines an interior area or space 26 of the canister 20 in which a grenade may be located, as described in more detail below.

As illustrated, in a preferred embodiment both the outer and inner casings 22,24 are generally cylindrical in shape. The size of the outer and inner casings 22,24 may vary, especially dependent upon the size of the grenade to be housed. The inner casing 24 has a smaller diameter than the outer casing 22 in order to permit the inner casing 24 to be located within the outer casing 22. This difference in diameter is also important in creating a baffle space or gap 27 between the outer and inner casing 22,24 (as illustrated in FIGS. 2 and 3). As will be discussed in greater detail below, this baffle space 27 is important, as it creates a buffer.

The interior space 26 is, as illustrated in FIG. 2, generally cylindrical in shape. It will be appreciated that the shape of the interior space 26 is dependent on the shape of the inner casing 24. The interior space 26 is preferably of an area/size that permits a grenade G of the invention to be enclosed by the inner casing 24 of the canister 20, as illustrated in FIG. 3. This requires, for example, that the inner casing 24 be of a length and diameter greater than the length and diameter of the housing of the grenade G to be placed therein.

The outer and inner casings 22,24 each have a pair of opposing ends. In a preferred embodiment, a top cover or plate 28 may be used to selectively cover or enclose a first or top end of the outer and inner casings 22,24. A bottom end or plate 30 covers or encloses a second, opposing end of the outer and inner casings 22,24. In an embodiment where the outer and inner casings 22,24 are generally cylindrical, the top plate 28 and bottom plate 30 are generally circular in shape.

The bottom plate 30 has a top surface 32 and a bottom surface 34. Both the outer and inner casings 22,24 are connected to the top surface 32 of the bottom plate 30. The top surface 32 of the bottom plate 30 is generally planar, and thereby forms a generally planar base of the interior area 26 of the canister 20.

The bottom surface 34 of the bottom plate 30 is generally planar. However, as will be described in greater detail below, in a preferred embodiment the bottom surface 34 of the bottom plate 30 is elevated in such a manner to prevent contact of the bottom plate 34 with an ignitable surface.

The top plate 28 forms a lid or cover of the canister 20. In a preferred embodiment, the top plate 28 can be moved from a first position in which it is disconnected from the canister 20 and does not obscure the first end of the outer casing 22 and inner casing 24, thus permitting access to the interior area 26, to a second position in which it is connected to the canister 20 and extends over and encloses the first end of the outer casing 22 and inner casing 24 of the canister 20.

The top plate 28 has a top surface and a bottom surface. In a preferred embodiment, an opening or passage 40 extends through the top plate 28. In one embodiment, the passage 40 is generally centrally located and comprises a generally circular bore. The passage 40 extends from the top surface of the top plate 28 to the bottom surface. The bottom surface of the top plate 28 defines the top of the interior area 26 of the canister 20.

Use of the passage 40 will be described in greater detail below. In general, however, the passage 40 permits a first portion of a grenade G (ex. safety pin, safety lever) to be located outside of the canister 20 while permitting a second portion of the grenade G to be enclosed by the canister 20.

In one embodiment, the top surface of the top plate 28 is generally planar. In a preferred embodiment, the bottom surface is substantially planar, but includes one or more sealing features. As best illustrated in FIGS. 2 and 3, a rib 31 extends downwardly from the bottom surface of the top plate 28. The rib 31 is preferably a circular extension which protrudes outwardly beyond the remainder of the bottom surface of the top plate 28 in an area corresponding to the outer and inner casings 22,24. As described in more detail below, the rib 31 serves to aid in closing or sealing the top or first end of the outer and inner casings 22,24 with the top plate 28. As will be appreciated, without the rib 31 and adjacent groove which accepts the inner casing 24, the top plate 28 would generally only rest upon the end of the outer and inner casings 22,24, and gas and flame would likely escape therefrom. The rib 31 and associated groove serve a baffling effect, creating a circuitous route along which any gas and/or flame must travel to escape. This reduces the probability of flame shooting out and damaging the surroundings.

In one embodiment, the top plate 28 has a generally circular peripheral edge. In a preferred embodiment, one or more lugs 36 extend outwardly from this edge. The lugs 36 preferably comprise flat tab-like protrusions that extend radially outwardly from the peripheral edge of the top plate 28. As illustrated, the top plate 28 preferably has three lugs 36. These lugs 36 are, in a preferred embodiment, equidistantly spaced around the perimeter of the top plate 28. The spacing between each lug 36 is thus dependent on the number of lugs 36.

Extending upwardly from a top end of the canister 20 is a lock ring 42. In a preferred embodiment, the lock ring 42 is attached to the outside of the outer casing 22 of the canister 20 and comprises a generally cylindrical or circular wall. As illustrated, the lock ring 42 encircles the first or top end of the outer and inner casings 22,24 of the canister 20 and extends beyond the top ends thereof. Preferably, the lock ring 42 extends upwardly a sufficient distance above the surface of the top plate 28 to prevent the exposed portion of a grenade G from becoming damaged during use and thereby causing the contents of the grenade G to be expelled.

In a preferred embodiment, the lock ring member 42 includes a plurality of notches 44 corresponding to the number of lugs 36. Each notch 44 extends downwardly from a top surface of the lock ring 42 to the top end of the outer and inner casings 22,24. Each notch 44 is shaped to permit an aligned lug 36 to be moved along the notch 44.

A slot 46 extends from each notch 44. Each slot 46 comprises a narrow slit which extends from the bottom portion of its respective notch 44 in a circumferential direction (i.e. generally perpendicular to the notch) around the lock ring 42. The slot 46 has a height which is slightly greater than the mating lug 36, and is generally longer than the width of the mating lug 36.

In one embodiment, the canister 20 includes a means for locking the top plate 28 when the top plate 28 is located over the first end of the outer and inner casings 22,24. In one embodiment, this means comprises a thumbscrew 48. The thumbscrew 48 includes a threaded shaft portion and a handle portion. The threaded shaft portion is configured to engage mating threads of a passage which extends through the lock ring 42 from an outer to an inner surface thereof. Preferably, this passage is in a position such that it is aligned with the top plate 28 when the top plate is connected to the canister 20. As detailed below, the thumbscrew 48 may be threaded into the passage through the lock ring 42 to engage the top plate 28, fixing the top plate 28 in position.

In a preferred embodiment, the canister 20 includes means for preventing the body thereof, including the top plate 28, outer casing 22 and bottom plate 30, from contacting a surface upon which the canister 20 is supported. In one embodiment, the means comprises a means for supporting the top plate 28, outer casing 22 and bottom plate 30 above a support surface.

In one embodiment, this means includes the lock ring 42. As illustrated, because the lock ring 42 extends beyond the top plate 28, if the canister 20 is located in its upside-down position, the top plate 28 will not contact a supporting surface. Instead, only the lock ring 42 will contact the surface.

In one embodiment, this means also comprises one or more fins 50. Each fin 50 comprises an elongate rib that extends outwardly from the outer casing 22. In one embodiment, each fin 50 extends from a point beyond the bottom portion of the bottom plate 30 to below the lock ring 42.

The one or more fins 50 preferably extend outwardly a sufficient distance to support the outer casing 22 above a surface upon which the canister 20 is located when the canister 20 is placed on its side. The distance by which the fins 50 extend outwardly may depend upon the total number of fins and the size and shape of the outer casing 22. In the embodiment illustrated, there are 6 fins spaced generally equidistantly apart about the outer casing 22.

The fins 50 may be connected to the outer surface of the outer casing 22, such as by welding. The fins 50 may also be formed integrally with the outer casing 22.

The one or more fins 50 also extend outwardly beyond the bottom plate 30 a sufficient distance to prevent the bottom plate 30 from contacting a support surface.

In one embodiment, one of the fins 50 is formed as a handle 54. As illustrated, the handle 54 comprises a generally "U"-shaped extension 57 extending from the fin 54, This extension 57 cooperates with the remainder of the fin 50 to define an opening 59. As described below, in this configuration, a user may grip the extension with a portion of his/her hand extending through the opening 59.

As described below, the canister 20 is designed to house a grenade G and permit the release of the gas or other material therefrom. Thus, the canister 20 includes means for permitting gas to flow from the interior area 26 to a point external to the canister 20.

In a preferred embodiment, this means comprises a plurality of ports or openings provided through the outer and inner casing 22,24. In one embodiment, a plurality of ports 52 are provided through the inner casing 24. These ports 52 extend through the inner casing 24, leading from the interior area 26 to the baffle space 27 between the outer and inner casing 22,24.

There may be a varied number of ports 52 arranged in various configurations. In the embodiment illustrated, the ports 52 are generally aligned in a row positioned generally midway between the first and second ends of the inner casing 24. As illustrated, there are twelve (12) ports 52. In one embodiment, each port 52 has a diameter of about 0.375 inches. Generally, the number and size of the ports are selected so that the gas is discharged without pressure build-up.

A plurality of ports 55 are provided through the outer casing 22. These ports 55 lead from the baffle space 27 between the outer and inner casings 22,24 to a point external to the canister 20. As illustrated, there are two rows of ports 55. A first row of ports is located near the lock ring 42, and a second row is located near the bottom plate 30. In one embodiment, the port 55 is located between each pair of fins 50 such that there are six (6) ports in each row.

As illustrated, in a preferred embodiment, the one or more ports 55 through the outer casing 22 are offset from the one or more ports 52 through the inner casing 24. The reason for this offset is described in more detail below.

One or more embodiments of the invention comprise a method of using a gas grenade in a manner which reduces the risk that the gas grenade may ignite other materials. One embodiment of the invention comprises a method of using the reusable gas grenade canister 20 described above.

In use, a gas grenade G such as that described in greater detail herein is associated with the canister 20. The canister 20 is opened, providing access to the interior space 26. In one embodiment, this step comprises disengaging the thumbscrew 48 from the top plate 28. The top plate 28 is then rotated with respect to the lock ring 42 until the lugs 36 are rotated with respect to the slots 46 until the lugs 36 align with the notches 44. The top plate 28 may then be moved upwardly with respect to the lock ring 42 to remove the top plate 28 from the canister 20.

Once the top plate 28 is removed, the interior space 26 is accessible. The grenade G is then located in the canister 20, as best illustrated in FIG. 3. In one embodiment, this requires that the fuse of a grenade G be removed, such as by unthreading it from the body or housing of the grenade.

In one embodiment, the fuse of the grenade G and the body or housing of the grenade G are then located on opposing sides of the top plate 28 at the opening 40 therein. The fuse is reconnected to the housing of the grenade G by passing the fuse through the opening 40 until it engages the grenade G.

In some instances, the grenade G may have a long safety lever which interferes with the top plate 28, preventing attachment of the fuse to the grenade G. In such a configuration, the safety lever must be shortened to prevent its interference with the top plate 28. The safety lever may be broken off, cut or otherwise shortened.

The top plate 28 may then be connected to the canister 20. The top plate 28 is lowered into engagement with the lock ring 42. As this occurs, the body or housing of the grenade G is lowered into the interior space 26. In order to engage the top plate 28 with the lock ring 42, the lugs 36 on the top plate 28 must be aligned with the notches 44 in the lock ring 42.

Once the lugs 36 of the top plate 28 reach the bottom of the notches 44, the top plate 28 is rotated. The top plate 28 is rotated (clockwise in the embodiment illustrated) until the lugs 36 are housed within the slots 46. In one embodiment, the lugs 36 extend outwardly of the lock ring 42 by a short distance, allowing a user to grasp them so that the top plate 28 may easily be rotated.

The thumbscrew 48 is then tightened, which prevents movement (including rotation) of the top plate 28. When locked into position, the top plate 28 closes the top or first end of the outer and inner casings 22,24 and associated interior space 26 and baffle area 27. At the same time, the body of the grenade G is enclosed inside the interior area.

The canister 20 is now ready for use. The safety pin on the grenade G is pulled, causing the grenade fuse to be ignited. The canister 20 housing the grenade G may be thrown to the desired location. In one embodiment, the canister 20 may be thrown by grasping the handle 54.

Referring to FIG. 3, when the grenade G is activated, gas, smoke and/or other material are emitted therefrom. Generally, this material is confined within the interior space 26. The bottom plate 30 and top plate 28 prevent the material from exiting the top or bottom ends of the inner casing 24.

The material is permitted to escape from the interior area 26 through the ports 52 through the inner casing 24. The material is then located in the baffle space 27 between the outer and inner casings 22,24 and the top and bottom plates 28,30.

Material is permitted to flow from the baffle space 27 to a point exterior to the container 20 through the one or more ports 55 in the outer casing 22.

The gas grenade canister 20 may be constructed of a wide variety of materials. In order to be durable and withstand the high heat generated by the gas grenade during use, the canister 20 may be constructed of iron, steel or a similar material.

The canister 20 may be constructed in a wide variety of manners. Various of the components of the canister 20 may be constructed integrally, or constructed separately and then connected.

It is contemplated that the canister 20 may have a wide variety of shapes. For example, the outer and inner casings 22,24 (or either of them) may be other than cylindrical, including oval or square. As indicated, the number of fins 50, their shape and size, may vary. Means other than fins may be used to elevate the main body of the canister 20 from a support service. These means may comprise legs, spikes or other elements.

Various numbers of ports 52,55 may be provided. As illustrated, the ports 52,55 are generally circular. They may have other shapes. The ports 52,55 may also be located in other positions and vary in number.

The top plate 28 may be selectively connected to the container 20 in a variety of fashions other than that described. For example, the top plate 28 might engage the lock ring 42 in a mating thread arrangement, or with a hinge or the like.

In one embodiment, the bottom plate 30 may also be removed, such as instead of the top plate 28. Such an arrangement would permit the grenade to be inserted from the bottom end of the container 20.

In one embodiment, other means may be provided for closing or sealing the top plate 28. For example, a gasket or the like may be used to prevent or inhibit the escape of flames and/or gas.

The container may be comprised of additional casings, resulting in additional baffle spaces. Such designs may, however, increase the weight of the casing undesirably.

A primary advantage of the invention is that a standard gas grenade may be utilized in a manner which reduces the likelihood that surrounding material may be damaged, including by combustion. As described above, when activated, a gas grenade often reaches very high temperatures and expels material at very high temperatures. In some instances, flame may actually be expelled.

In accordance with the present invention, the hot gas grenade is contained within a container. The container includes means for maintaining surfaces thereof which are exposed to the grenade and/or the hot material which is expelled from surrounding surfaces. In particular, the outer casing, bottom plate and other surfaces which are exposed to the grenade and/or hot material are always elevated by the fins above a support surface. This prevents heat from the grenade and/or expelled material from being directly transferred to the support or surrounding surface and provides an insulated air barrier.

In addition, the container prevents hot material, including flame, from being directly expelled in a manner which would result in damage to the supporting or surrounding surface. In the preferred embodiment, material expelled from the grenade must travel a circuitous route from the interior space to the exterior of the container. In the embodiment illustrated, this route requires the material to change directions three times and travel approximately 6.5" distance to escape the container. This prevents, for example, flame from being expelled from the container.

In the preferred embodiment, the ports 52 in the inner casing 24 are offset a maximum distance from the ports 55 in the outer casing 22. Further, the ports 52 in the inner casing 24 are located a maximum distance from the material release points of the grenade. This configuration serves to provide a maximum "baffle" effect. While the container provides a "baffle" effect, the container does not prevent the release of the material.

A particular advantage of the invention is that the container may be reused many times. Unused grenades may be loaded into the container and then used, and then used grenades removed and discarded.

The container is easy to use. The top plate may be easily connected and disconnected from the container without tools, and yet effectively seals the interior and baffle space of the container. The particular embodiment of the invention described makes the use of the top plate or lid and container simple. Minimum rotation is needed to align the lugs of the top plate with the lock ring (maximum 60 degrees). Locking is achieved by simply rotating the top plate when the lugs reach the bottom of the notches in the lock ring.

Because of its ease of use, the canister can be used in varying conditions, including in the light or in the dark.

The handle permits the canister, and the enclosed grenade, to be thrown to the desired location. The size, weight and durability protect the grenade within. For example, a user may use the container to propel a grenade through a window or the like while protecting the grenade and ensuring its operation.

Figure 4:
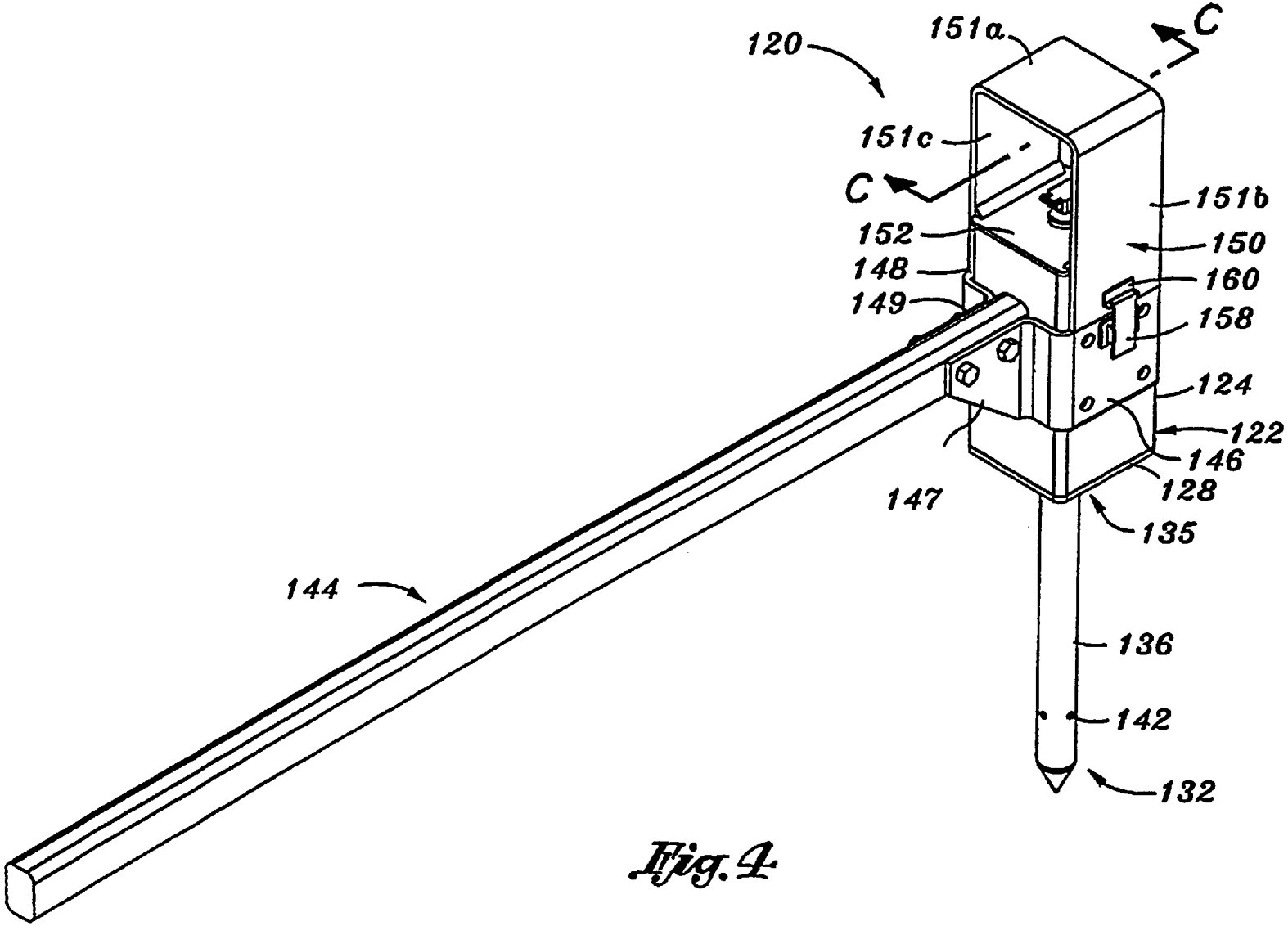
FIG. 4 is a perspective view of a reusable gas grenade canister in accordance with a second embodiment of the invention.

Another embodiment of the invention is illustrated in FIG. 4. In this embodiment of the invention, the gas grenade canister 120 includes a penetrating spike having a passage that extends from a housing or body defining an interior space that houses a gas grenade. As described in greater detail below, the spike may be used to penetrate an object, such as a wall. The configuration of the canister 120 causes gas from a gas grenade to be routed through the spike to a location remote from the gas grenade. This remote location may be, for example, the interior of a building.

In one embodiment of the invention, as illustrated in FIG. 5, the gas grenade canister includes a housing or body 122. In one embodiment, the body 122 has the shape of a generally rectangular cylinder. The body 122 has an outer surface 124 and an inner surface, and defines an interior space 126 for, as best illustrated in FIG. 6, housing a grenade G.

It will be appreciated that the shape and size of the interior space 126 is dependent on the shape and size of the housing or body 122 of the canister 120. The shape and size of the housing or body 122 may vary, such as to be large enough to accommodate a variety of shapes and sizes of grenades, or may be specifically configured to house a particular grenade.

In the embodiment illustrated, the body 122 has a first or top end and an opposing second or bottom end. In a preferred embodiment, a bottom plate 128 encloses one end (the second or bottom end) of the body 122, and thus encloses one end of the interior space 126. In one embodiment, the bottom plate 128 is generally planar.

Figure 6:
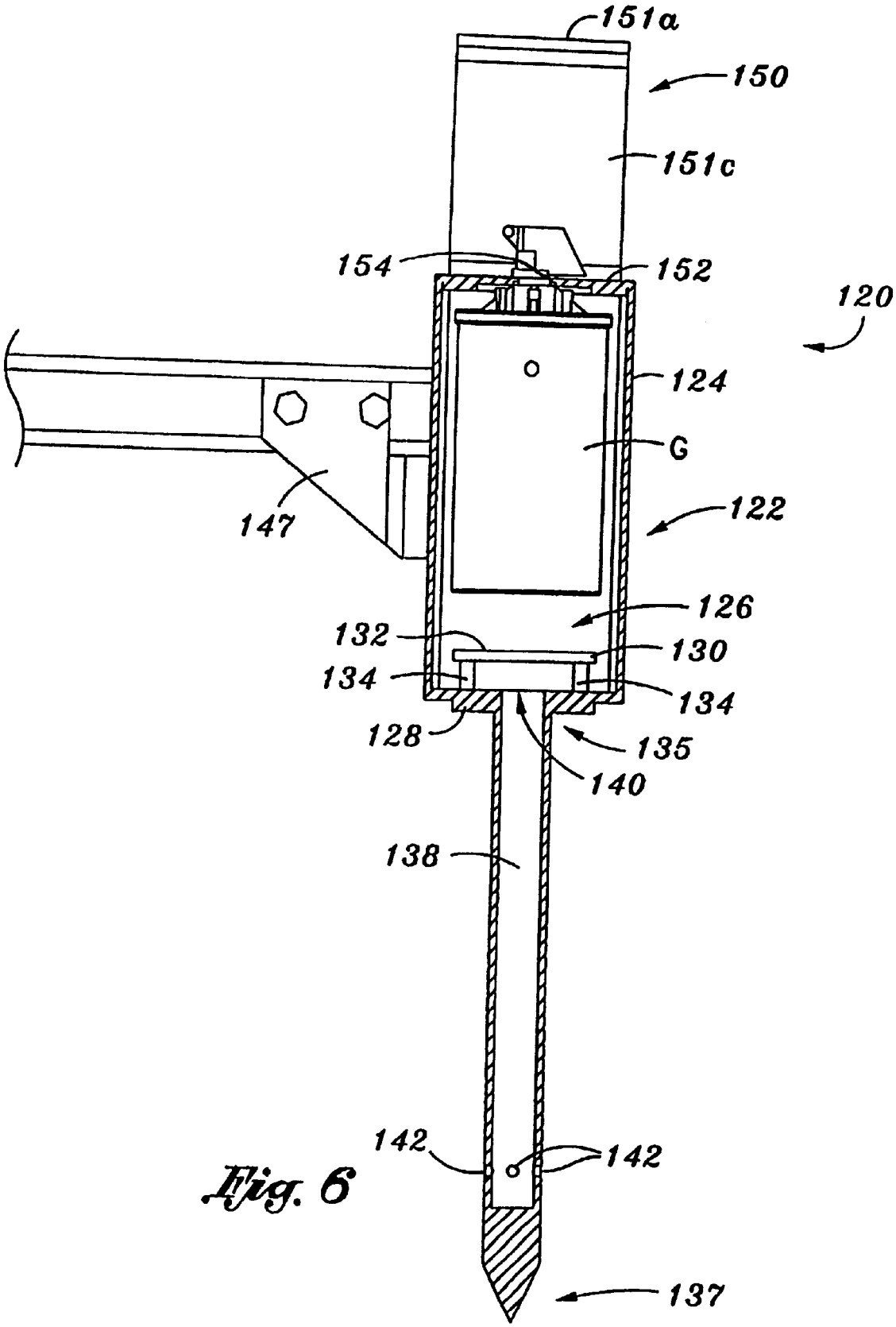
FIG. 6 is a plan cross-sectional view of the reusable gas grenade canister illustrated in FIG. 4 taken along line c—c therein.

Referring to FIG. 6, extending upward from the bottom plate 128 into the interior space 126 is a baffle plate 130. As detailed below, the baffle plate 130 serves as a buffer or baffle for gasses, flame and other material flowing from a grenade.

In one embodiment, the baffle plate 130 is comprised of a generally planar base 132 that extends parallel to the bottom plate 128 of the interior space 126. Most importantly, the baffle plate 130 is positioned above the bottom plate 128. In one embodiment, the baffle plate 130 is supported by one or more legs 134. In one embodiment, two legs 134 extend upwardly from the planar base 132 to the bottom plate 128.

In a preferred embodiment, the baffle plate 130 is smaller in size than the bottom plate 128, and is smaller in dimension than the cross-sectional area of the interior space 126. As illustrated in FIG. 6, in this configuration, a gap or space is provided between the inner surface of the housing or body 122 and the outer edge of the baffle plate 130. Gas released from a gas grenade may flow through this space or spaces.

This gap or space leads to the gap or space between the baffle plate 130 and bottom plate 128.

In a preferred embodiment, the gas grenade canister 120 includes means for directing gas released by a gas grenade to a point remote from the body 122. In a preferred embodiment, this means comprises a passage through which gas is directed from the interior space 126 to a remote point. In one embodiment, the passage is defined by a penetrating spike 136.

Figure 7:
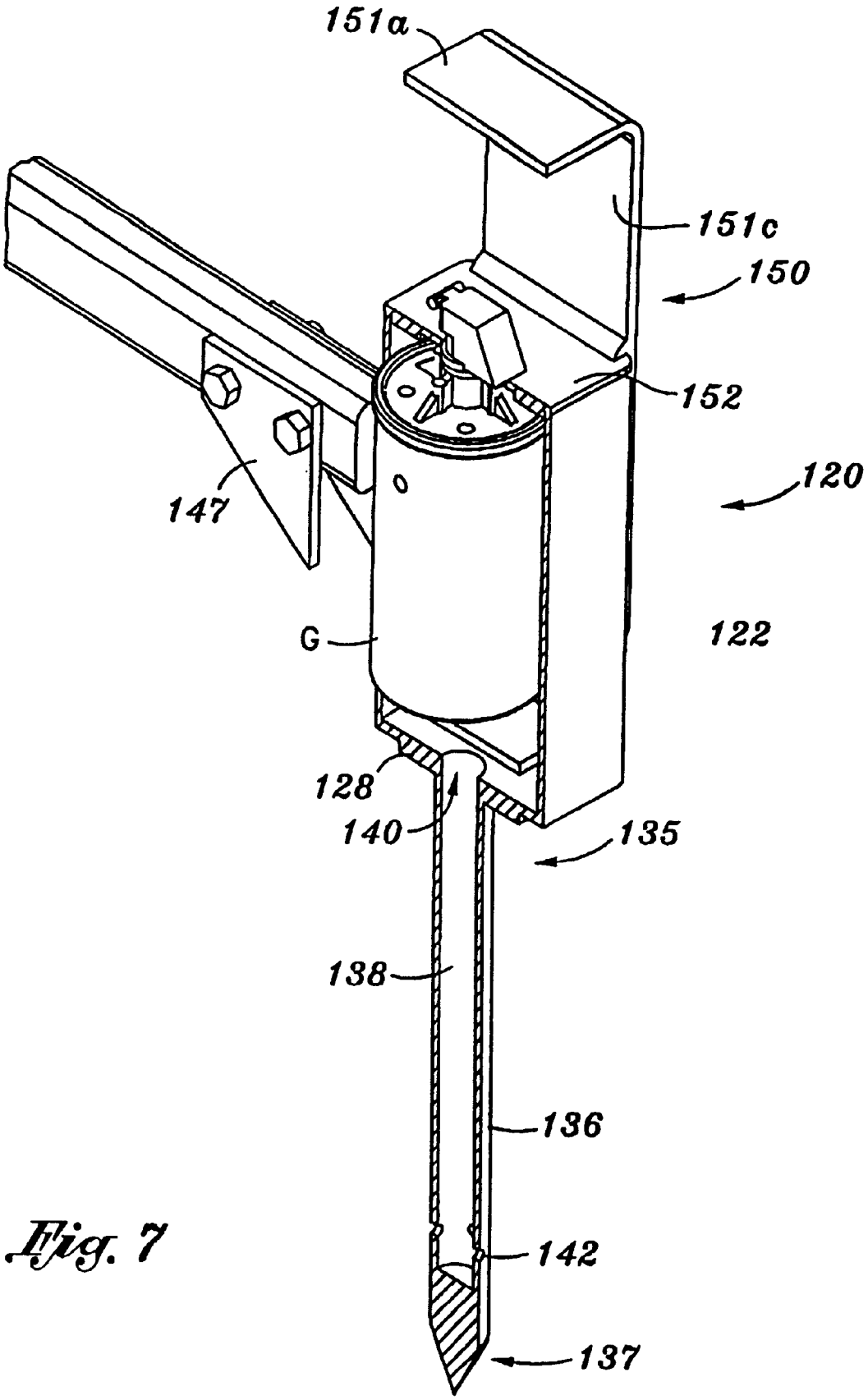
FIG. 7 is a perspective cross-sectional view of the reusable gas grenade canister illustrated in FIG. 4 taken along line c—c therein.

Referring primarily to FIGS. 6 and 7, in one embodiment, the spike 136 has a first end 135 and a second end 137. The first end 135 is connected to the body 122. In one embodiment, the first end 135 of the spike 136 is integrally formed with the bottom plate 128. The second end 137 is located remote from the body 122. In another embodiment, the spike 136 may be removable from the body 122. For example, the first end 135 of the spike 136 may be threaded for connection to mating threads on the body 122. Other means may be similarly provided for permitting a spike 136 to be connected to or disconnected from the body 122. This arrangement has the advantage that if a spike 136 is damaged, such as by being bent or the like, the spike 136 may be easily replaced.

As illustrated, in a preferred embodiment, the second end 137 of the spike 136 has a pointed, needle or spear-tip. The spike 136 is otherwise generally cylindrical. As described in greater detail below, the spike 136 is generally elongate, permitting it to penetrate a member, such as a wall, and route gas from the interior 126 of the body 122 to the remote location.

In a preferred embodiment, the penetrating spike 136 includes an internal passage 138. The passage 138 extends from the first end 135 to the second end 137 of the spike 136. Preferably, the internal passage 138 is centrally located within the spike 136, and, in one embodiments is generally tubular in shape.

In a preferred embodiment, an opening or passage 140 extends through the bottom plate 128 from the interior space 126 to the passage 138 through the spike 136. In one embodiment, the opening 140 is located beneath the baffle plate 130, generally centrally within the bottom plate 128. As described below, this opening 140 permits gas to flow from the interior space 126 into the passage 138 through the spike 136, thus routing the gas from the body 122.

As illustrated, one or more ports 142 extend from the exterior of the spike 136 at its second end 137 to the passage 138 through the spike 136. In one embodiment, four ports 142 are provided, the ports arranged equidistantly from one another about the exterior of the spike 136. In one embodiment, the ports 142 are generally circular in cross-sectional shape. The ports 142 may vary in number, shape and location. Preferably, the ports 142 are configured to permit gas which is routed into the passage 138 to be expelled from the spike 136. Further details regarding use and operation of the spike 136 are provided below.

Referring primarily to FIG. 4, in a preferred embodiment, the grenade canister 120 includes a swing arm 144. The swing arm 144 extends outwardly from the housing or body 122 of the canister 120, preferably generally perpendicular to the spike 136. In one embodiment, the swing arm 144 comprises an elongate member, such as a section of rectangular tubing as illustrated. The swing arm 144 may have other shapes and comprise, for example, an elongate rod. Preferably, the swing arm 144 is relatively long so, as described in more detail below, it may be used to swing the housing or body 122 with a high velocity for imparting sufficient force to permit the tip of the spike 136 to penetrate objects. The swing arm 144 may be, for example, 28 inches to 36 inches in length.

The swing arm 144 is connected to the gas grenade canister 120, preferably in a manner such that the swing arm 144 extends from the body 122 generally perpendicular to the spike 136. In one embodiment, the first and second handle bracket members 146,148 are attached to the outer surface 124 of the housing or body 122. As illustrated, the brackets 146,148 engage opposite sides of the body 122 of the canister 120. The brackets 146,148 each include a mounting portion 147,149 which extends outwardly from the body 122. An end of the swing arm 144 is positioned between the spaced mounting portions 147,149 and is connected thereto. As illustrated, the connection is by a pair of bolts, permitting the swing arm 144 to be disconnected from the body 122 if desired. In other embodiments, the swing arm 144 may be connected by welding, lock pins or other means.

Referring to FIGS. 5 and 6, during use, a gas grenade G is preferably enclosed in the body or housing 122. As such, the gas grenade canister 120 includes a top plate 152 for selectively closing the top end of the body 122 opposite the bottom plate 128.

In a preferred embodiment, the top plate 152 is associated with a ram pad or plate 150. As described in more detail below, when a gas grenade G is used with the canister 120, a top portion thereof extends through and above the top plate 152. The ram pad or plate 150 protects this protruding portion of the gas grenade G and preferably defines a contacting surface upon which force may be applied.

In one embodiment, the ram pad 150 comprises a generally "U"-shaped member having a generally planar central contacting surface 151*a* and a pair of opposing legs 151*b,c*. In a preferred embodiment, the legs 151*b,c* are spaced by the same distance as the width of the body 122, permitting them to slide along and be attached to the body 122, as illustrated in FIGS. 4 and 5.

In this embodiment, the top plate 152 is mounted to the ram pad 150. In particular, the top plate 152 is attached to the legs 151*b,c* of the ram pad 150 and is located beneath;:and spaced from, the central contacting surface 151*a*. In one embodiment, the length of the legs 151*b,c* is chosen such that when the top plate 152 is engaged with the top of the body 122, the legs 151*b,c* rest upon the brackets 146,148.

As in the previous embodiment, the top plate 152 has a top surface and a bottom surface. As illustrated in FIG. 6, a passage or opening 154 extends through the top plate 152. In one embodiment, the passage 154 is centrally located. As described below, the passage 154 permits the extension of a portion of a gas grenade G therethrough.

In the embodiment described and illustrated, the top plate 152 is removable (with the ram pad 150). Thus, in one embodiment, means are provided for sealing the top plate 152 to the housing or body 122 in order to prevent gas and the like emitted by an activated gas grenade G from escaping from the interior space 126. As illustrated in FIG. 5, in one embodiment, the means for sealing includes a lip 155 on the bottom surface of the top plate 152 extending about its periphery. The lip 155 is configured so that a portion of the top plate 152 fits within the body 122 and a portion extends over the top end of the body 122. In addition, in one embodiment the means includes a gasket 156. As illustrated, the gasket 156 preferably sits between the top end of the body 122 and the overlapping portion of the bottom surface of the top plate 152.

Preferably, means are provided for selectively connecting the ram pad 150, and thus the top plate 152, to the body 122, and for disconnecting the ram pad 150, and thus the top plate 152, from the body 122. In one embodiment, this means comprises a pair of latches 158. As illustrated in FIGS. 4 and 5, the latches 158 are connected to the brackets 146,148. In one embodiment, each latch 158 comprises a pivoting element for selective engagement with a mating catch 160 located on the exterior of one of the legs 151*b,c* of the ram pad 150. The means for selectively connecting may comprise a variety of other elements, such as a rotating latch, sliding pin or other element.

A method of using the gas grenade canister 120 described above will now be detailed. In use, as in the previous embodiment, a gas grenade G like that described in greater description herein is associated with the canister 120. The canister 120 is opened, providing access to the interior space 126. In one embodiment, this step comprises disengaging the one or more latches 158. In the embodiment illustrated, the latches 158 are disengaged by pressing on a lower portion thereof, thus pivoting an upper portion thereof out of engagement with the mating catch 160.

Once the latches 158 are disengaged, the ram pad 150 may be moved upwardly, as illustrated in FIG. 5, away from the body 122. At the same time, the top plate 152 is lifted out of engagement with the body 122.

Once the ram plate 150 and top plate 152 are removed, the interior space 126 is accessible. The grenade G is then located in the canister 120 as best illustrated in FIG. 6. In one embodiment, this requires the fuse (as in the previous embodiment) to be removed from the grenade G. In one embodiment, the fuse of the grenade G and the body or housing of the grenade G are then located on opposing sides of the top plate 152 at the opening 154 therein. The fuse is reconnected to the housing of the grenade G by passing the fuse through the opening 154 until it engages the grenade G.

The top plate 152 is then connected to the canister 120, preferably by lowering the ram pad 150 and top plate 152 back over the body 122 and engaging the latches 158. As the ram pad 150 is being lowered, it will be appreciated that the grenade G is being lowered into the interior space 126.

The canister 120 is now ready for use. In a preferred embodiment, the spike 136 is passed through a member, such as a wall, door or the like so that gas may be directed into a space located on the other side of the member which is penetrated. In general, in order to force the spike 136 through a member, force must be applied.

In one embodiment, a user grasps the swing arm 144 and uses it to swing the canister 120 so that the spike 136 is driven in to the member. In another embodiment, force is applied to the ram pad 150, which in turn drives the spike 136 through the member. In one embodiment, both actions may be employed: the spike 136 is initially "set" by swinging the container 120 so that the spike 136 at least partially penetrates the member, and then a force is applied to the ram pad 150 to completely drive the spike 136 through the member. A force may be applied to the ram pad 150 in a variety of manners, including by use of a hammer or the like.

Preferably, the spike 136 is driven through the member a sufficient distance to expose the ports 142 at the second end 137 thereof on the other side of the member. Once the spike 136 is in the desired location, the safety pin on the grenade G may be disengaged and the grenade ignited or activated.

Referring to FIG. 6, when the grenade G is activated, gas, smoke or other material is emitted therefrom. Generally, as in the previous embodiment, the material is confined within the interior space 126. The material emitted into the interior space 126 by the gas grenade G flows around the baffle plate 130 and through the opening140 in the base plate 132 into the internal passage 138 of the spike 136. The material then flows through the ports 142, where it is released.

This embodiment of the gas grenade canister 120 has many of the same advantages as the canister 20 described above, as well as some additional advantages. First, the canister once again provides a reusable device for containing a gas grenade and directing the material emitted therefrom. In this embodiment, however, the material is released at a point remote from the body.

Like the previous embodiment, this canister includes baffling which reduces the possibility of flame or the like from being emitted. In particular, gas and flame must pass under the baffle plate and then through the spike before being released. The route and distance of this pathway substantially reduces the probability that flame may be emitted. This reduces the probability that the emission of the gas may harm surroundings, such as starting elements on fire or scorching them.

This canister has the advantage that it may be used to release material, such as gas, to a remote area. For example, in the case of a building, the spike may be passed through a door or wall. The gas is then directed through the spike into the interior space of the building, where it is most effective. The spike thus serves not only as a means for penetrating the building or other barrier, but as a directing pathway for the gas or other material.

One advantage of the canister 120 is that means are provided for driving the spike through a barrier. This means includes the swing arm and the ram pad.

Advantageous, the ram pad protects the top plate and the top of the grenade which protrudes therefrom. In the embodiment illustrated, applied force is directed by the ram pad to the brackets where the force is spread out over the body, reducing the likelihood of damage to the body.

Like the last embodiment, this embodiment canister may have variety of configurations. For example, the canister need not include a swing arm. The canister need not include a ram pad (the top plate may be an independent element). The swing arm and/or ram pad may comprise other elements and be configured in other manners.

The various components of the canister may be constructed of a variety of materials. The components may be integrally formed, connected or the like as desired to optimize manufacturing efficiencies.

In one embodiment, the canister may include more than one spike. The one or more spikes may define one or more passages through which gas and other material may flow. There may be a greater or lesser number of ports through which the gas or other material is released from each spike. The spike may have a variety of configurations and need not have a pointed tip. For example, the spike may have a tapered tip or end. In one embodiment, the one or more passages through the spike may be linear and extend to the end of the spike.

The body may include other internal baffling or no baffling. For example, the body may have an interior wall and exterior wall separated by a space and including flow paths, in similar fashion to the embodiment canister 20 described above.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A reusable gas grenade canister for housing a gas grenade comprising:

an outer casing and an inner casing, said outer casing and said inner casing each having a first end and an opposing enclosed second end, said inner casing defining a grenade holding interior space, a top plate for selectively closing said first end of said outer casing and said inner casing, said top plate moveable between a first position and a second position, said first position allowing for access to said interior space, said second position effectively closing said first end of said outer casing and said inner casing and said interior space, said outer casing spaced from said inner casing creating a baffle space between said inner casing and said outer casing; and one or more first ports extending through said inner casing defining one or more passages from said interior space to said baffle space, one or more second ports extending through said outer casing from baffle space to a point external to said canister, said one or more first ports offset from said one or more second ports.

2. The reusable gas grenade canister in accordance with claim 1 including a lock ring extending from said first end of said outer casing.

3. The reusable gas grenade canister in accordance with claim 2 wherein said lock ring comprises a generally circular wall having a top and a bottom, said top of said lock ring positioned outwardly of said top end of said outer casing, at least one notch extending downwardly into said wall from said top towards said bottom and a slot extending from said notch generally perpendicular to said notch.

4. The reusable gas grenade canister in accordance with claim 1 including at least one fin extending outwardly from said outer casing.

5. The reusable gas grenade canister in accordance with claim 1 including at least one lug extending outwardly from a peripheral edge of said top plate for engagement with said at least one notch in said lock ring.

6. The reusable gas grenade canister in accordance with claim 1 including an aperture extending through said top plate.

7. The reusable gas grenade canister in accordance with claim 1 including a plurality of fins extending outwardly from said outer casing.

8. The reusable gas grenade canister in accordance with claim 7 wherein said outer casing is generally cylinder shaped and said fins extend generally radially outward from said outer casing.

9. A reusable gas grenade canister comprising:

a generally cylindrical outer casing having a top end and a bottom end;

a generally cylindrical inner casing having a top end and a bottom end and defining an interior space, said inner casing located in said outer casing, said inner casing and said outer casing defining a baffle space therebetween;

a bottom plate enclosing said bottom end of said outer casing and said bottom end of said inner casing;

a lock ring extending outwardly from said top end of said outer casing, said lock ring comprising a generally circular wall;

a top plate for connection to said lock ring in a position in which said top plate encloses said top end of said outer casing and said top end of said inner casing;

one or more first passages leading through said inner casing from said interior space to said baffle space;

one or more second passages leading through said outer casing from said baffle space to a point exterior to said outer casing;

a plurality of fins spaced apart from one another and extending generally radially outward from said outer casing.

10. The reusable gas grenade canister in accordance with claim 9 wherein said lock ring includes a plurality of notches extending downwardly from a top portion thereof towards said outer casing and said top plate includes a plurality of lugs extending outwardly of a peripheral edge thereof for alignment with said notches.

11. The reusable gas grenade canister in accordance with claim 10 wherein a slot extends into said lock ring from a bottom portion of each notch generally perpendicular to said notch and said lugs are configured to be rotated into said slots.

12. The reusable gas grenade canister in accordance with claim 11 including means for locking said top plate in a position relative to said lock ring when said lugs of said top plate are located in said slots.

13. The reusable gas grenade canister in accordance with claim 9 wherein one or more of said fins extends outwardly of said bottom plate of said canister.

14. The reusable gas grenade canister in accordance with claim 9 wherein at least one of said fins is configured as a handle, said fin having an opening therein which may be gripped by a user.

15. The reusable gas grenade canister in accordance with claim 9 wherein said top plate includes an aperture therethrough for accepting a portion of a gas grenade.

* * * * *

UNITED STATES PATENT AND TRADEMARK OFFICE

CERTIFICATE OF CORRECTION

PATENT NO. : 6,581,521 B1 
DATED : June 24, 2003
INVENTOR(S) : Robert G. Dixon and Robert G. Dixon, Jr.

It is certified that error appears in the above-identified patent and that said Letters Patent is hereby corrected as shown below:

Column 12,
Line 42, after "beneath," please delete ";:" and insert therefor -- , --.

Signed and Sealed this

Twenty-sixth Day of August, 2003

JAMES E. ROGAN
*Director of the United States Patent and Trademark Office*